US008662926B2

(12) United States Patent
Droesbeke

(10) Patent No.: US 8,662,926 B2
(45) Date of Patent: Mar. 4, 2014

(54) SHIELDED CONNECTOR WITH IMPROVED POSITIONING OF THE SHIELD

(75) Inventor: Gert Droesbeke, Geel (BE)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 13/262,361

(22) PCT Filed: Mar. 29, 2010

(86) PCT No.: PCT/EP2010/054088

§ 371 (c)(1),
(2), (4) Date: Jan. 9, 2012

(87) PCT Pub. No.: WO2010/112456

PCT Pub. Date: Oct. 7, 2010

(65) Prior Publication Data

US 2012/0129398 A1 May 24, 2012

(30) Foreign Application Priority Data

Mar. 31, 2009 (WO) ..... PCT/IB2009/053462

(51) Int. Cl.
*H01R 13/648* (2006.01)

(52) U.S. Cl.
USPC ..... 439/607.55

(58) Field of Classification Search
USPC ..... 439/607.01, 607.35–607.39, 607.55
See application file for complete search history.

(56) References Cited

U.S. PATENT DOCUMENTS

| | | | | |
|---|---|---|---|---|
| 5,094,627 | A | 3/1992 | Uekido | 439/610 |
| 5,539,620 | A * | 7/1996 | Gale et al. | 361/800 |
| 7,285,004 | B1 | 10/2007 | Fukuda et al. | 439/358 |
| 8,052,469 | B2 * | 11/2011 | Mao et al. | 439/607.01 |
| 8,259,457 | B2 * | 9/2012 | Mills | 361/753 |
| 2006/0154524 | A1 | 7/2006 | Huang et al. | 439/607 |
| 2007/0280603 | A1 | 12/2007 | Sakata et al. | 385/88 |
| 2008/0108235 | A1 | 5/2008 | Muroi et al. | 439/157 |
| 2012/0129398 | A1 * | 5/2012 | Droesbeke | 439/607.55 |
| 2012/0225583 | A1 * | 9/2012 | Kamarauskas et al. | 439/607.01 |

* cited by examiner

*Primary Examiner* — James Harvey
(74) *Attorney, Agent, or Firm* — Harrington & Smith

(57) ABSTRACT

Connector including a connector body and a shield. The shield includes a shield side wall. The connector body includes at least one side wall provided with an abutment structure extending from this side wall, so as to allow a precise positioning of the shield side wall.

8 Claims, 5 Drawing Sheets

SHIELDED CONNECTOR WITH IMPROVED POSITIONING OF THE SHIELD

FIELD OF THE INVENTION

The present invention relates to shielded connectors.

BACKGROUND

In the art of electronics, it is well known to provide connectors with a shield around the connector body for preventing emission and/or pick up of EMI noise to and/or by nearby objects, e.g. signals in other connectors, signals on circuit boards, etc. When mounting the connector to a further object, such as a printed circuit board, the shield may require accurate positioning, e.g. for fitting and/or contacting to the further object such as for providing mechanical stability to the connector and/or for connecting the shield to a ground potential. Such mounting may be done by hand, but preferably it is automated. Automation may generally require very strict tolerances for parts. A further aspect is that connectors of one design may be processed and mounted to further objects by consumers using various types of automated machines, hindering optimisation of the connector with respect to any particular type of machine.

With the ongoing desire for reduced connector sizes and faster production, tolerances tend to be reduced further, which complicates manufacture and enhances the risk of increased rejection percentages.

SUMMARY

In order to provide an improved connector which facilitates meeting tolerance requirements, a connector according to claim 1 is provided.

In the connector, the first abutment structure provides a fulcrum or support at a dedicated, predetermined abutment position for the first shield wall. The first position of the first edge portion being fixed with respect to the connector body allows a reliable position of the second edge portion with respect to the connector body. The first position of the first edge portion may be linked to the connector body so as to allow some restricted displacement or movement of the first edge portion relative to the connector. The first and second edge portions may extend along the entire shield wall at an associated side of the shield. The longer the separation between the position of the first edge portion and the position of the first abutment portion, relative to the separation between the position of the second edge and the position of the first abutment portion, the more accurately the second edge is positioned since the position of the second edge then becomes less sensitive to position inaccuracies of the first edge.

The shield may be clamped to the abutment structure, but fixing the shield to the abutment structure may not be required.

The improved positioning accuracy holds in particular for connectors with a shield wall closely following the connector body side wall, in particular a substantially flat or plane connector body side wall and a substantially plane first shield wall. In such a case, any undesired protrusion from the side wall and/or shield wall or any debris particle between the side wall and the shield wall might otherwise form an unintended fulcrum, causing the second edge to become displaced from its intended second position with respect to the (fixed) first position of the first edge and the connector body.

The shield may extend along several side walls of the connector body, e.g. being bent and/or wrapped around at least a portion of the connector body. The first edge portion may be a bent or folded edge between the first shield wall and a further shield portion.

The connector allows for a slight misplacement of the position of the first edge such as a bend or fold in the shield with respect to the connector body, in particular to a corner of the connector body, and/or a relatively large (bending) radius of the shield with respect to a relatively sharp corner of the connector body about which the first edge portion is (to be) arranged. Such misplacement or relatively large radius might otherwise cause an inaccurate positioning of the shield with respect to the corner of the connector body and thus of the connector as a whole, and/or cause a separation between the shield and the connector body side by an unpredictable amount. Such inaccuracies are prevented with the present connector. Thus, the present connector body and shield may be manufactured with less strict overall tolerances with respect to each other, facilitating manufacturing costs.

The connector may comprise a second side wall and a second shield wall, as defined in claim 2. The first and second side walls and first and second shield walls may be adjacent each other, e.g. being adjacent wall portions. Alternatively they may be substantially parallel to each other or be arranged at an angle to each other, e.g. at a mutual angle of ca. 30, ca. 45, ca. 60 or ca. 90 degrees, etc.

It should be noted that the connector may comprise one or more further side walls and one or more further shield walls corresponding in construction to what is defined in claim 1 and/or 2.

The first and second shield walls may be part of a generally U-shaped shield. The U-shape may be relatively sharp, rounded, polygonal such as Π-like, it may also have a more complex shape. In the case of a sharp shape, the (first position of the) first edge portion of the first shield wall and the (fourth position of the) first edge portion of the second shield wall may coincide at the apex of a V-shape.

A shape with substantially opposite, substantially parallel first and second shield walls, such as a U- or a Π-like shape, facilitates picking up the shield, or the assembled connector comprising the shield, by their opposite first and second sides. This may be done with automated gripping tools.

The connector of claim 3 provides stability against torsion, rotation and/or generally warping of the first shield wall. This allows implementing a relatively thin shield wall with reduced stiffness, reducing costs for material and/or manufacturing. Advantageously each abutment structure is elongated, with each associated shield wall being parallel to that abutment structure.

The elongated abutment structure may be a single elongated object, e.g. a rib-like protrusion. The abutment structure may also comprise a plurality of objects, e.g. two or more protrusions or bumps, each such object in itself possibly being an elongated object. This may reduce material consumption with respect to a single elongated object. The abutment structure or objects comprised in the abutment structure may be attached to the connector body in any suitable manner or be an integral whole with the connector body. In a shield wall, an abutment structure may further be provided by deforming a portion of the shield wall such as by folding, bending or coining.

The first and/or second edge portions may also run substantially parallel to the first abutment structure, equalizing the separations between the first edge portion and the abutment structure and between the second edge portion and the abutment structure along their respective lengths and further improving their relative positional accuracy. The same holds for (the first and/or second edge portions of) the second and/or further shield walls and second and/or further abutment portions The connector of claim 4 increases determining and/or maintaining positional accuracy of the second edge of at least the first shield wall with respect to the fourth side. The third and fourth sides of the connector body may be an upper side and a lower side of the connector (body) when in operational position, e.g. as identifiable with respect to a mounted position onto a further object. E.g., the lower side may be a board-mounting side.

The connector of claim 5 facilitates connecting the shield to a further object, e.g. a printed circuit board, and contacting the shield such as for grounding it.

The connector of claim 6 allows an air space between the connector and an object to which the connector is mounted. The space may be configured for facilitating mounting, e.g. accommodating mounting structures such as solder balls and/or for venting fumes and/or heat from a soldering process. The space may also serve for cooling the connector when in operation.

The connector of claim 7 facilitates ventilation of the connector. It may further assist cooling and/or venting the connector during a soldering process. The apertures may advantageously be arranged at or near a lower side of the connector (body), by which the shielding efficiency of the shield may be substantially unaffected.

Additional aspects are defined in claim 8.

These and other aspects and benefits will be more fully explained hereafter with reference to the drawings showing an exemplary embodiment.

DETAILED DESCRIPTION OF EMBODIMENTS

In the Figures, like objects and elements are indicated with like reference signs.

Figure 1A:
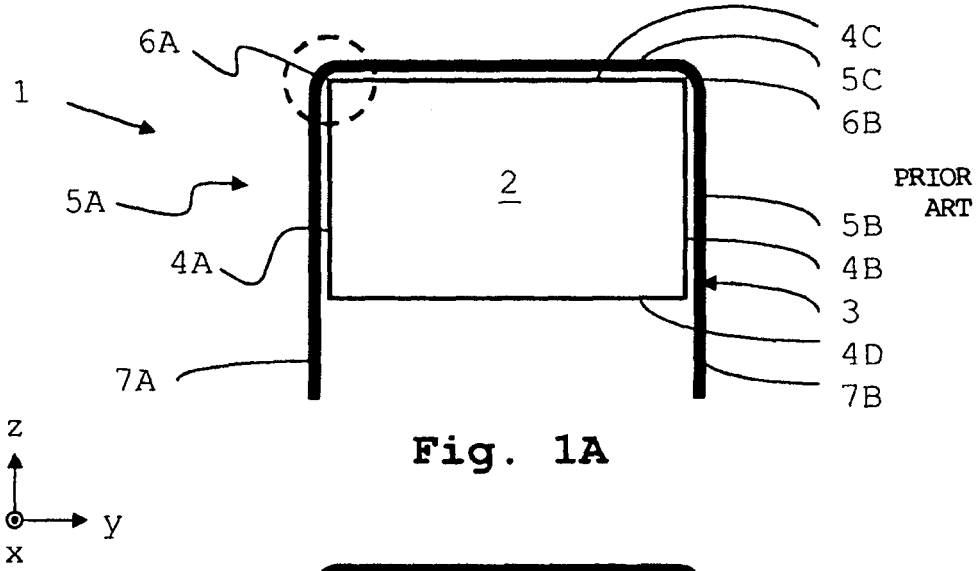
FIGS. 1A-1C are schematic cross-section views of a connector without an abutment structure.
Figure 1B:
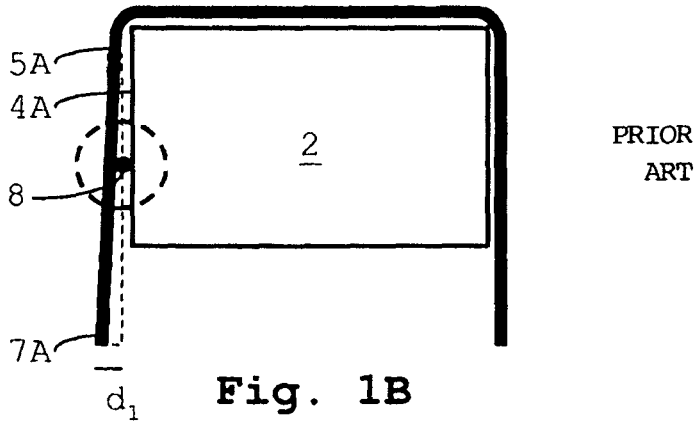
Figure 1C:
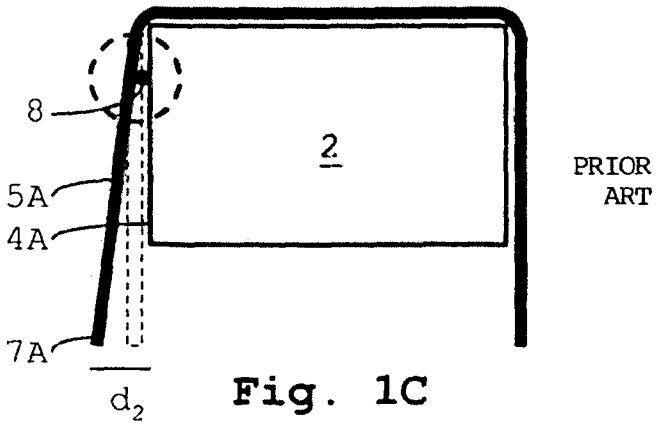

FIGS. 1A-C are schematic cross-sectional views of a connector 1 comprising a connector body 2 and a shield 3. The connector body 2 comprises opposite first and second side walls 4A and 4B, a top wall 4C and a bottom wall 4D. The shield 3 comprises opposite first and second shield walls 5A and 5B. The shield walls 5A and 5B extend along the connector body side walls 4A and 4B, respectively. In FIG. 1A a reference coordinate system is indicated.

The shield walls 5A and 5B each extend between a first edge portion 6A and 6B, respectively, and a second edge portion 7A and 7B, respectively. Here, the first edge portions 6A and 6B are formed by a folded edge between the shield walls 5A and 5B and a further shield portion 5C, here being a top shield wall 5C.

In FIG. 1A is shown in the dashed circle that the inherent radius of curvature of the folded first edge portion 6A comes into contact with the connector body 2 and prevents the shield 3 to closely follow both the top and side walls 4C and 4A (4B, respectively) of the connector body 2. Consequently, the position of the first edge portion 6A with respect to the connector body 2 is not accurately defined in at least the y- and z-directions. The position of the second edge portion 7A depends on the position of the first edge portion 6A and is therefore neither accurately determined with respect to the connector body 2 in at least the y- and z-directions. The position of the second edge portion 7A is even less accurately defined than that of the first edge portion 6A since a small angular deviation off the intended position of the shield wall 5A about the indicated corner of the connector body 2 results in a relatively large deviation of the second edge portion 7A.

FIGS. 1B and 1C indicate that such angular deviation of the intended orientation of the shield wall 5A may also be brought about by an unintended object 8 positioned in between the connector body side wall 4A and the shield wall 5A, see the dashed circles. In FIGS. 1B and 1C the intended position of the shield wall 5A and thus of the second edge 7A is indicated with thin dashed lines. The object 8 causes the position of the second edge 7A to deviate by an amount $d_1$ or $d_2$ in the y-direction, dependent on the size and the position in the z-direction of the object 8. A similar effect may occur also for the opposite shield wall 5B (not shown), resulting in a relatively large deviation from the intended separation of the respective second edges 7A, and 7B.

The object 8 may be any type of object such as a debris particle or other foreign object, a burr on the shield 3, a protrusion of the connector body 2, e.g. due to an egress of connector body material from an inadequate seal of a mould, or an artefact of an uneven setting or curing of moulding or cast material of the connector body 2, for example.

Figure 2:
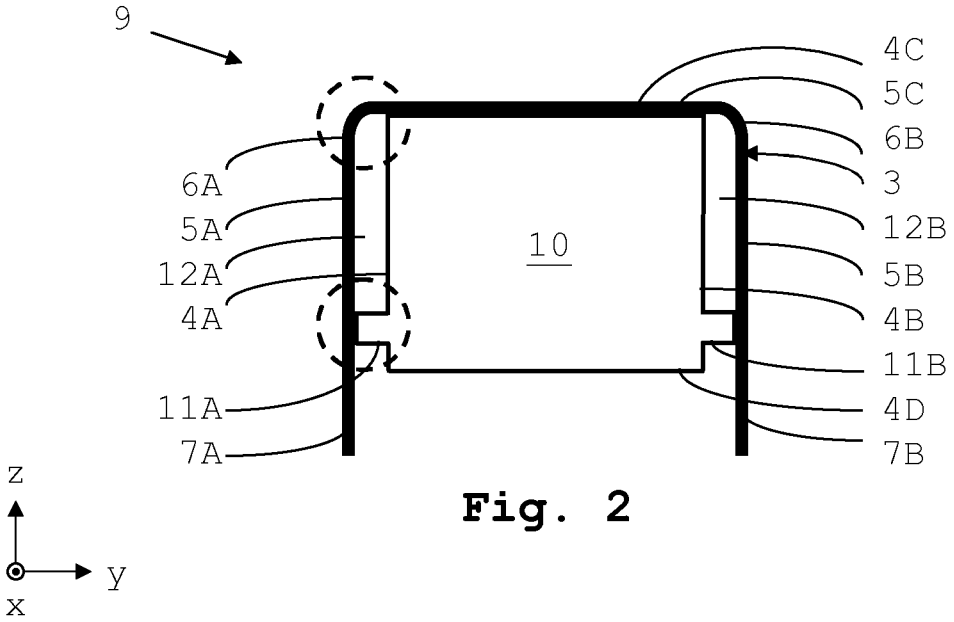
FIG. 2 is a schematic cross-section view of an improved connector comprising an abutment structure.
Figure 3A:
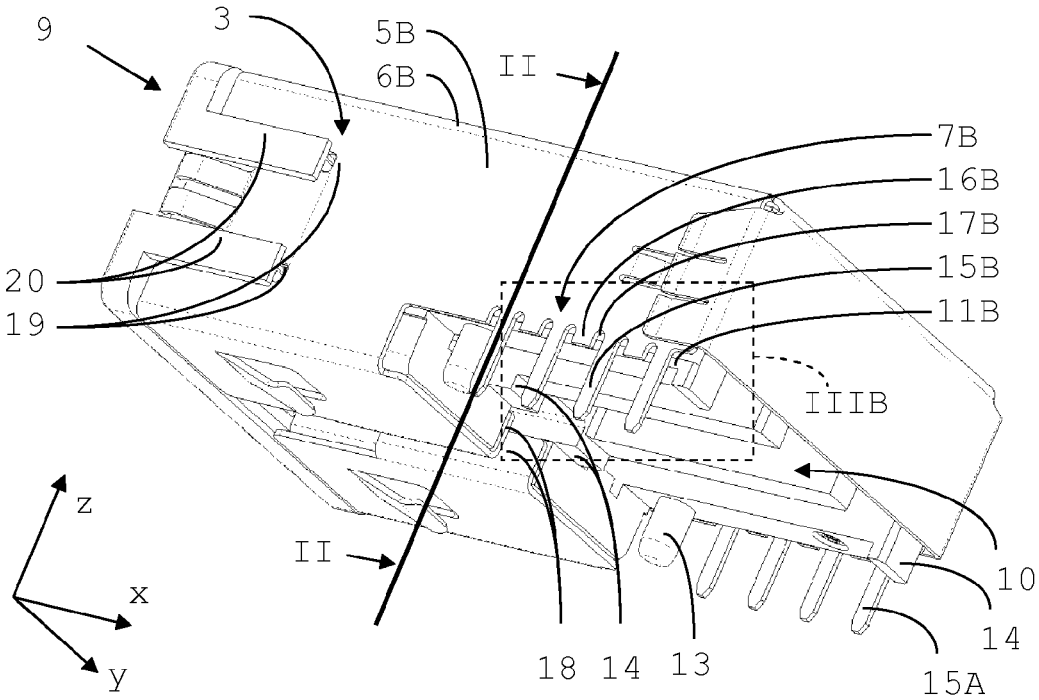
FIG. 3A is a perspective view of an embodiment of an improved connector comprising an abutment structure, indicating the plane of the cross section of FIG. 2 at II-II and a detail IIIB shown enlarged in FIG. 3B.
Figure 3B:
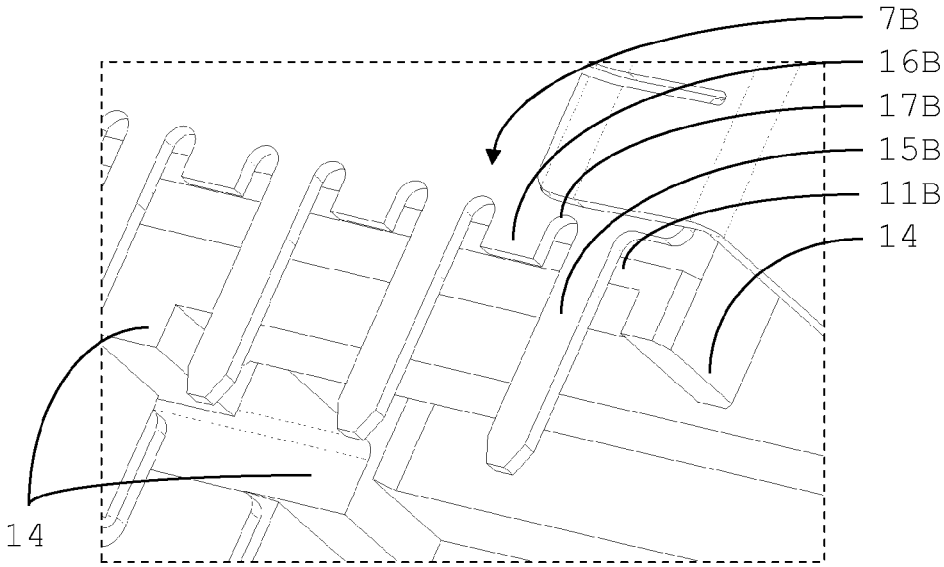
FIG. 3B is an enlarged view of the detail 111B indicated in FIG. 3A.
Figure 4A:
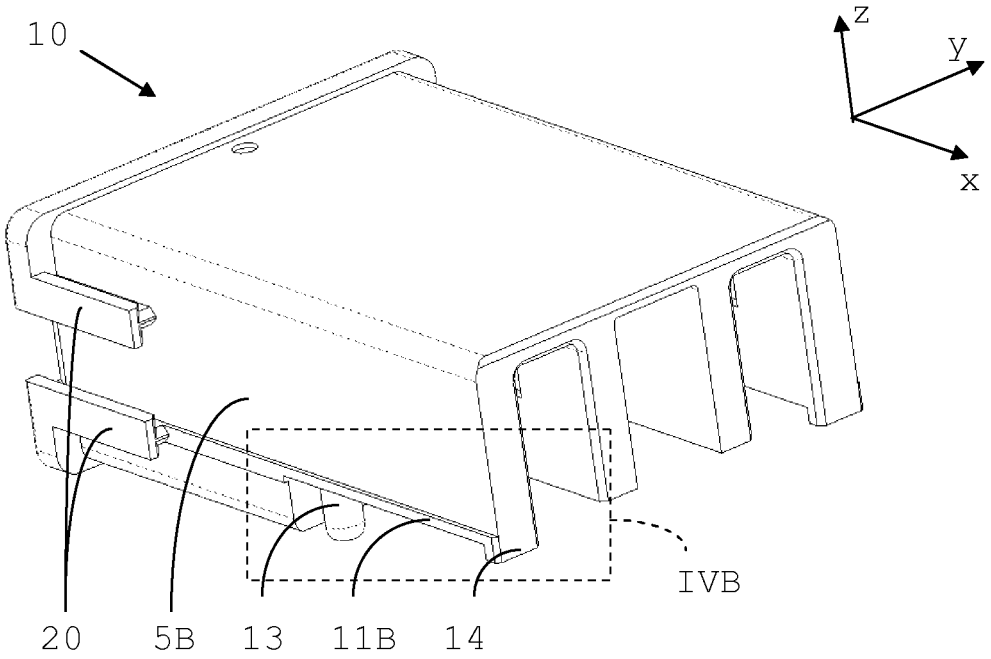
FIG. 4A is a perspective view of the connector body of the connector of FIG. 3A.
Figure 4B:
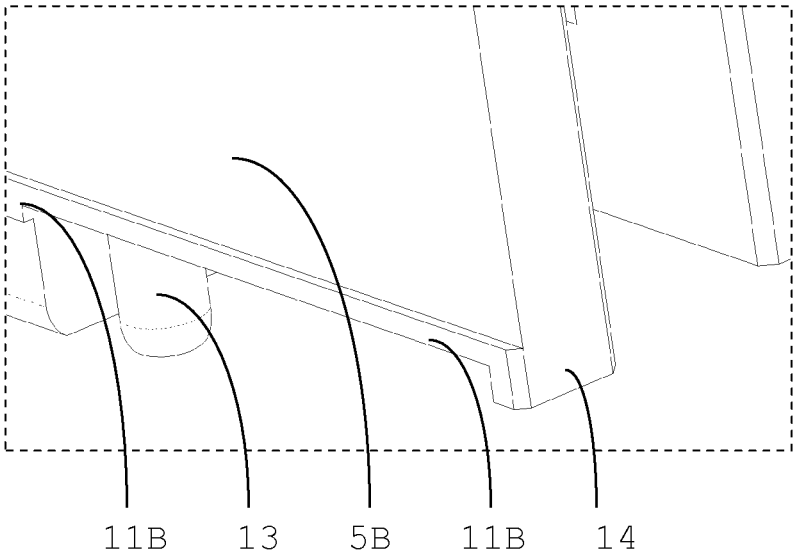
FIG. 4B is an enlarged view of the detail IVB indicated in FIG. 4A.

FIG. 2 is a schematic cross-sectional view similar to FIGS. 1A-1C of an improved connector 9, an embodiment of which is shown in perspective and in more detail in FIGS. 3A-5B. The location of the cross sectional plane of FIG. 2 is indicated in FIG. 3A with the line II-II.

The connector 9 comprises an improved connector body 10 which in turn comprises abutment structures 11A and 11B. The abutment structures 11A and 11B are arranged on the side walls 4A and 4B, respectively, between the top and bottom walls 4C and 4D. In the connector 9, the first and second shield walls 5A and 5B extend along the side walls 4A and 4B of the connector body, being spaced therefrom by a space 12A, 12B, respectively, and the shield walls 5A and 5B abut the abutment structures 11A, 11B.

It will be appreciated from a comparison of FIGS. 1A-1C on the one hand and FIG. 2 on the other hand, that the shield walls 5A and 5B only abut the connector body 10 at the abutment structures 11A, 11B, respectively, being substantially free from contact with (the side walls 4A, 4B of) the connector body 10. Inaccuracies in the position of the first edge portions 6A, 6B are absorbed by the spaces 12A, 12B. Also, an unintended object 8 happening to be positioned between the shield wall 5A, 5B and the side wall 4A, 4B, will have little to no effect on the position of the second edge portions 7A or 7B.

FIGS. 3A-5B are different views of (portions of) the connector 9. The shown connector 9 is a right-angle connector, the bottom wall 4D of the connector 9 being configured for mounting to a printed circuit board (not shown) with board mounting pegs 13 and stand-offs 14. However, the concepts disclosed here are not limited to such type connectors and are applicable to many different types of connectors. The connector body 10 of the connector 9 is substantially enveloped by the folded shield 3. The first and second shield walls 5A (not visible) and 5B are arranged substantially opposite each other. In FIG. 3A the second shield wall 5B is visible. The abutment structures 11A, 11B extend substantially along the entire length of the side walls 5A, 5B of the connector body 10 (see FIGS. 4A, 4B).

The second edge portions 7A and 7B of the shield walls 5A, 5B comprise contact portions 15A, 15B which extend beyond (a part of) the fourth side 4D of the connector body 10 for contacting the printed circuit board. The second edge portions 7A, 7B further comprise optional fingers 16A, 16B. The contact portions 15A, 15B and the fingers 16A, 16B, abut the abutment structures 11A, 11B. The contact portions 15A, 15B and the fingers 16A, 16B, are separated by optional indentations 17A, 17B. The indentations 17A, 17B allow deflection of a first contact portion 15A, 15B relatively independent of an adjacent finger 16A, 16B and/or an adjacent second contact portion 15A, 15B, improving the positional accuracy of (the finger 16A, 16B and/or the second contact portion 15A, 15B of) the edge portion 7A, 7B with respect to the abutment structure 11A, 11B and therewith respect to the first edge portion 6A, 6B and the connector body 10 as a whole, compared to a second edge portion 7A, 7B without indentations 17A, 17B.

Figure 5A:
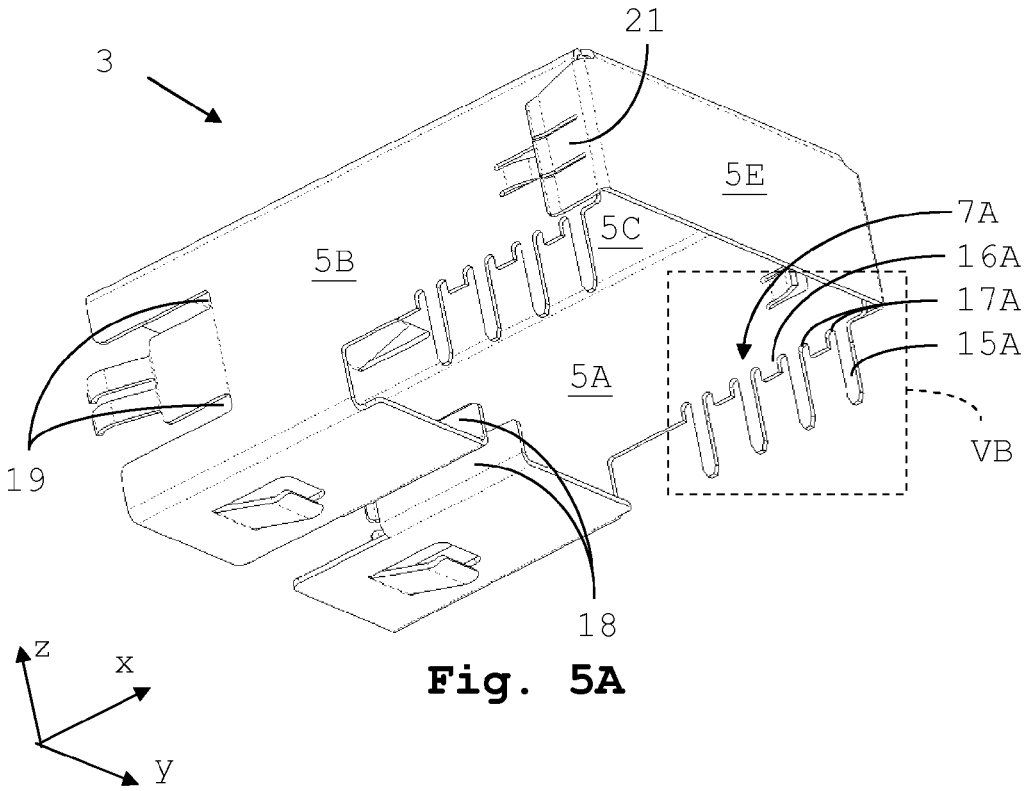
FIG. 5A is a perspective view of the shield of the connector of FIG. 3A.
Figure 5B:
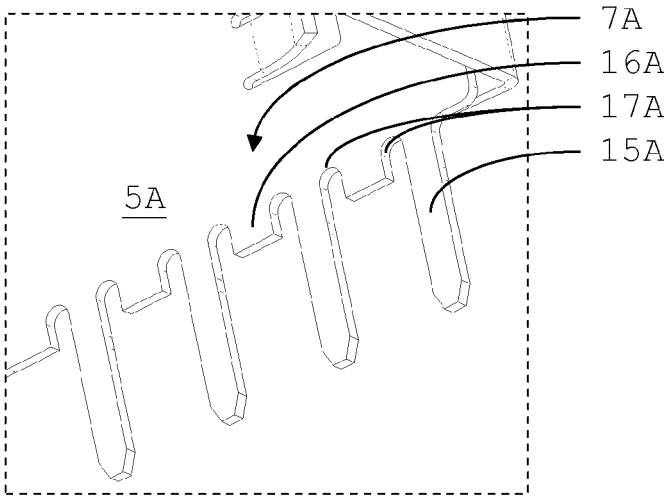
FIG. 5B is an enlarged view of the detail VB indicated in FIG. 5A.

As shown most clearly in FIGS. 3A and 5A the shield 3 is clamped on the connector body 10 by folded shield portions 18, gripping a corresponding recess in the bottom wall 4D of the connector body 10. The relative positions of the shield 3 and the connector body 10 are further defined by recesses 19 in the shield fitting protrusions 20 on the connector body 10. The protrusions 20 extend from the side walls 4A, 4B with an undercut closest to the side walls 4A, 4B providing a general T-shape perpendicular to the side walls 4A, 4B for further holding the shield walls 5A, 5B. The T-shape of the protrusions 20 may further reduce or prevent the shield walls 5A, 5B from getting out of shape in case a folded angle of the first edge portions 6A, 6B happens to be inaccurate. The shield walls 5A, 5B are further prevented from getting out of shape or from getting off by gripping portions 21 from a rear shield wall 5E. In this way the shield 3 and in particular the edge portions 6A, 6B are substantially fixed in position relative to the connector body 10. Additional attachment means may be provided, e.g. glue, soldering, one or more snapping or riveting structures, etc.

Since folding a metal sheet may be less accurate than moulding a material, the abutment structures 11A, 11B improve the positional accuracy of (the contact portions 15A, 15B of) the second edge portions 7A, 7B and facilitate mounting the connector 9 to the printed circuit board.

In sum, the connector 9 may be seen as a right-angle connector having a parallelepiped shape with a six sides; a front side, a rear side (cf. 5E), a top side (cf. 4C, 5C), a bottom side (cf. 4C), opposite left and right sides (cf. 4A, 5A and 4B, 5B, respectively). The shield walls at the left side (5A), the right side (5B) and the rear sides (5E) are each connected to the top side (5C) with respective first edges (6A, 6B) and each having respective second edges (7A, 7B) towards a bottom side (cf. 4D). And the position accuracy of the shield 3, and in particular each second edge portion 7A, 7B of the shield, with respect to the connector body 10 is primarily determined by the position of the first edge 6A, 6B with respect to the connector body 10 and the position of the abutment portion, which is determined by the abutment structure 11A, 11B and the shield wall 5A, 5B. The rear side of the connector 9 may also be provided with an abutment structure for improving the positional accuracy of the lower edge portion of the shield wall 5E.

Figure 6:
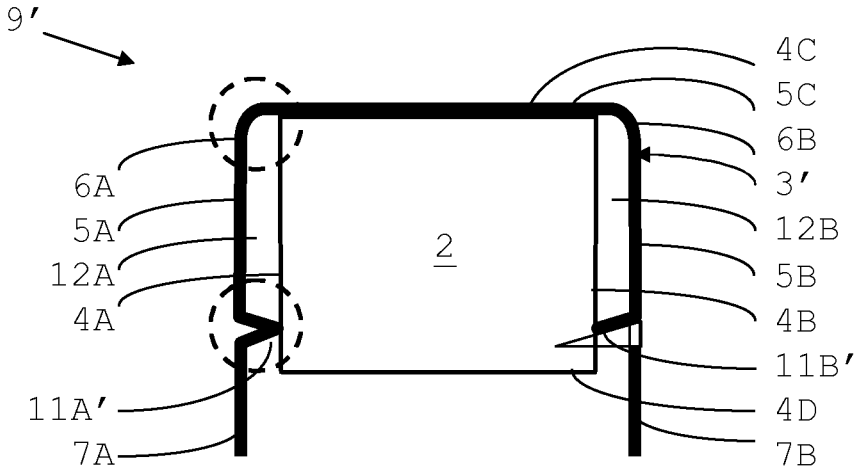
FIG. 6 is a schematic cross-section view of another embodiment of an improved connector.

FIG. 6 is a cross-sectional view of an alternative embodiment of an improved connector 9', similar to the embodiment of FIG. 2. In the connector 9' of FIG. 6 the shield 3' comprises first and second abutment structures 11A' and 11B', which are formed as deformations of the shield walls 5A, 5B. The first abutment structure 11A' is formed as an indentation in the first shield wall 5A for abutting the connector body 2. The second abutment structure 11B' is formed as a cantilevered portion cut out of the second shield wall 5B and bent inward for abutting the connector body 2.

The connector 9, 9' may be gripped with a vacuum suction tool on the top wall 4C, by a pinch-grip on the opposite side walls 5A, 5B or other suitable means, and be placed on the printed circuit board. The board mounting pegs 13 may be used for fixing the connector 9, 9' to the board. The stand-offs 14 create a small space between the bottom wall 4D of the connector body and the board. Contact terminals of the connector (not shown) may be contacted to corresponding contacts on the printed circuit board by a soldering step. Gases or fumes may be vented from the solder spots through the space between the bottom wall portion 4D of the connector body 10 and the board. The space may also allow visual inspection of the soldered contacts. In contrast to the shown embodiment, the fingers 16A, 16B may extend beyond the bottom wall 4D of the connector body 10 and may also abut the board. In such case apertures formed by indentations 17A, 17B may serve for venting soldering fumes and possibly for visual inspection.

The invention is not restricted to the above described embodiments which can be varied in a number of ways within the scope of the claims. For instance, the connector may be configured for mounting to other objects than a printed circuit board. Further, contact portions of the shield may be contact pins, eye-of-the-needle contacts or comprise one or more other contact terminal designs. One or more contact portions may be bent parallel or perpendicular to the corresponding shield wall for adapting to a contact position on a further object.

Features and aspects described with respect to one embodiment may be suitably combined with features and aspects described with respect to another embodiment.

The invention claimed is:

1. Connector comprising a connector body and a shield the connector body comprising a first side wall, and the shield comprising a first shield wall extending between a first edge portion and a second edge portion, wherein the first edge portion has a first position with respect to the connector body, and the second edge portion has a second position with respect to the connector body, the first position being fixed with respect to the connector body, wherein the first shield wall extending along the first side wall is spaced from it, and wherein at least one of the connector body or the shield comprises a first abutment structure extending from the first side wall, or the first shield wall, respectively, so as to abut the first shield wall or the first side wall at a predetermined first abutment location arranged at a third position in between the first and second positions such that the second position of the second edge portion with respect to the connector body is determined by the first position of the first edge portion and the third position of the first abutment structure.

2. Connector according to claim 1, wherein the connector body comprises a second side wall, and the shield comprises a second shield wall, extending between a first edge portion and a second edge portion, wherein the first edge portion of the second shield wall has a fourth position with respect to the connector body, and the second edge portion of the second shield wall has a fifth position with respect to the connector body, the fourth position being fixed with respect to the connector body, wherein the second shield wall extends along the second side wall being spaced from it, and wherein at least one of the connector body or the shield comprises a second abutment structure extending from the second side wall or second shield wall, respectively, so as to abut the second shield wall or the second side wall, respectively, at a predetermined second abutment location arranged at a sixth position in between the fourth and fifth positions such that the fifth position of the second edge portion of the second shield wall with respect to the connector body is determined by the fourth position of the first edge portion of the second shield wall and the sixth position of the second abutment structure, where the distance from the fourth position of the first edge portion of the second shield wall to the sixth position of the second abutment structure is greater than the distance from the second edge portion of the second shield wall to the second abutment structure.

3. Connector according to claim 1, wherein at least the first abutment structure is elongated, the first shield wall and the first abutment structure being arranged substantially parallel.

4. Connector according to claim 1, wherein the connector body comprises a third side and a fourth side, wherein the first edge portion of at least the first shield wall is arranged at or near the third side of the connector body and the second edge portion of the first shield wall is arranged at or near the fourth side of the connector body, wherein the first abutment structure is arranged at or near the fourth side of the connector body.

5. Connector according to claim 1, wherein the second edge portion of at least one of the first and second shield walls comprises one or more contact portions extending beyond the fourth side of the connector body.

6. Connector according to claim 1, wherein the connector body comprises one or more stand-offs for providing a separation between the connector body and a surface onto which the connector is mounted or to be mounted.

7. Connector according to claim 1, wherein the second edge of at least one of the first and second shield walls comprises one or more apertures.

8. Connector comprising a connector body and a shield the connector body comprising a first side wall and a second side wall substantially opposite each other, and the shield comprising a first shield wall extending between a first edge portion and a second edge portion, and a second shield wall substantially opposite the first shield wall extending between a third edge portion and a fourth edge portion wherein the first edge portion has a first position with respect to the connector body, the second edge portion has a second position with respect to the connector body, the third edge portion has a third position with respect to the connector body and the fourth edge portion has a fourth position with respect to the connector body, the first position and third position being fixed with respect to the connector body, wherein the first shield wall extends along the first side well being spaced from it and the second shield wall extends along the second side wall being spaced from it, wherein the connector body comprises a third side and a fourth side, the first edge portion and the third edge portion being arranged at or near the third side of the connector body and the second edge portion and the fourth edge portion being arranged at or near the fourth side of the connector body, wherein the connector body comprises a first abutment structure arranged at or near the fourth side of the connector body and extending from the first side wall so as to abut the first shield wall at a predetermined first abutment location arranged at a fifth position in between the first and second positions such that the second position of the second edge portion with respect to the connector body is determined by the first position of the first edge portion and the fifth position of the first abutment structure and the connector body comprises a second abutment structure arranged at or near the fourth side of the connector body and extending from the second side so as to abut the second shield wall at a predetermined second abutment location arranged at a sixth position in between the third and fourth positions such that the fourth position of the fourth edge portion with respect to the connector body is determined by the third position of the third edge portion and the sixth position of the second abutment structure.

* * * * *